US009068455B2

(12) United States Patent
Nien et al.

(10) Patent No.: US 9,068,455 B2
(45) Date of Patent: Jun. 30, 2015

(54) PNEUMATIC ENGINE SYSTEM WITH AIR CIRCULATION

(71) Applicants: Yu-Hun Nien, Nantou County (TW); Fan-Kai Tseng, New Taipei (TW)

(72) Inventors: Yu-Hun Nien, Nantou County (TW); Fan-Kai Tseng, New Taipei (TW)

(73) Assignees: Yu-Hun Nien, Nantou County (TW); Kuo-Lun Hsu, New Taipei (TW)

( * ) Notice: Subject to any disclaimer, the term of this patent is extended or adjusted under 35 U.S.C. 154(b) by 409 days.

(21) Appl. No.: 13/671,329

(22) Filed: Nov. 7, 2012

(65) Prior Publication Data

US 2014/0123638 A1 May 8, 2014

(51) Int. Cl.

| | |
|---|---|
| ***F01B 17/02*** | (2006.01) |
| ***F01L 1/00*** | (2006.01) |
| ***F01B 31/00*** | (2006.01) |
| ***F04B 1/00*** | (2006.01) |
| *F01L 1/06* | (2006.01) |
| *F01L 5/04* | (2006.01) |

(52) U.S. Cl.

CPC ..... *F01B 17/02* (2013.01); *F01B 31/00* (2013.01); *F04B 1/00* (2013.01); *F01L 1/00* (2013.01); *F01L 1/06* (2013.01); *F01L 5/04* (2013.01)

(58) Field of Classification Search

CPC ..... F01B 17/02; F01B 31/00; F04B 1/00; F01L 1/00; F01L 1/06; F01L 5/04; F15B 1/027

USPC ..... 60/407, 412

See application file for complete search history.

(56) References Cited

U.S. PATENT DOCUMENTS

| | | | | | |
|---|---|---|---|---|---|
| 3,925,984 | A | * | 12/1975 | Holleyman | 60/370 |
| 4,311,084 | A | * | 1/1982 | Pierce | 91/188 |
| 4,769,988 | A | * | 9/1988 | Clark, Jr. | 60/370 |
| 5,515,675 | A | * | 5/1996 | Bindschatel | 60/370 |
| 5,957,795 | A | * | 9/1999 | Hawes | 474/112 |
| 6,397,722 | B1 | * | 6/2002 | Eddington | 91/170 R |
| 7,258,140 | B2 | * | 8/2007 | Acree | 137/899.4 |
| 7,866,251 | B2 | * | 1/2011 | Nien | 91/248 |

* cited by examiner

*Primary Examiner* — Nathaniel Wiehe
*Assistant Examiner* — Qi Gan
(74) *Attorney, Agent, or Firm* — Chun-Ming Shih

(57) ABSTRACT

A pneumatic engine system uses gas circulation to recycle exhausted air, so as to reduce gas consumption, save energy, protect the environment, operate for a longer duration, and slow down the attenuation of the power output thereof. The pneumatic engine system includes a pneumatic engine, a gas storage device, a transit gas storage tank, and a suction device. The pneumatic engine receives a compressed air to generate power output. The gas storage device stores the compressed gas and supplies the compressed gas to the pneumatic engine. The transit gas storage tank receives gas discharged from the pneumatic engine. The suction device extracts gas from the transit gas storage tank and transport the extracted gas to the gas storage device for recycle.

6 Claims, 7 Drawing Sheets

PNEUMATIC ENGINE SYSTEM WITH AIR CIRCULATION

BACKGROUND

1. Technical Field

The present application relates to a pneumatic power apparatus, and more particularly, to a gas engine system with air circulation.

2. Related Art

Invention of the internal combustion engine drove Industrial Revolution and brought flourish development in human civilization. However, the internal combustion engine using fossil fuels produces carbon dioxide after combustion. In addition to causing air pollution, the greenhouse effect and global warming, carbon dioxide has already endangered the survival of human and biological. Pneumatic engine mainly makes use of high pressure air to transforming gas into rotation power. Since its discharge is also air, there are no foul odor and no pollution. Cost is also lower than gasoline and diesel. Therefore, the pneumatic engine is a good power generation choice. The use of high pressure gas of pneumatic engine is from a high pressure gas cylinder where gas is compressed. Gas consumption of pneumatic engine is in a large volume. High pressure gas cylinder to supply pneumatic engine cannot last long. This causes the power output from pneumatic engine to attenuate; and consequently, the pneumatic engine cannot continue to operate. It is thus an important topic to reduce gas consumption with the same amount of gas supply, so as to increase the operation duration of the engine and slow down the attenuation of the power output.

BRIEF SUMMARY

A pneumatic engine system with gas circulation operable to reduce gas consumption rate is provided. The pneumatic engine system with gas circulation allows gas exhausted from the engine to be recycled to solve the problem of traditional gas supply by the high pressure gas cylinders. This system comprises a pneumatic engine, a gas storage device, a transit gas storage tank, and a suction device. The pneumatic engine accepts a compressed gas to produce power output. The gas storage device stores the compressed gas and provides it to the pneumatic engine. The transit gas storage tank retrieves a gas discharged from the pneumatic engine. The suction device extracts gas from the transit gas storage tank and delivers the extracted gas to the gas storage device. Then gas can thus be recycled.

The gas storage device comprises three gas tanks. The first gas tank is used to store the compressed gas and to provide the compressed gas to the pneumatic engine. The second gas tank also stores the compressed gas. The pressure in the second gas tank is less than the pressure in the first gas tank. Therefore, a first booster pump located between the first and second gas tank is used to pressurize output gas from the second gas tank. The pressurized compressed gas is then delivered to the first gas tank. The third gas tank stores the compressed gas and the pressure in the third gas tank is less than the pressure in the second gas tank. A second booster pump located between the second and third gas tanks is used to pressurize gas output from the third gas tank. The pressurized gas is stored in the second gas tank. Gas discharged from the first and second booster pumps output to the transit gas tank for recycling. The suction device transports the recycled gas from the transit gas storage tank to the second and third gas tanks.

In some embodiments, a pneumatic engine system may further comprise an air compressor/gas storage cylinder set.

When the pressure in the third gas tank is insufficient, the air compressor/gas storage cylinder set supplements the pressure in the third gas tank.

The suction device comprises a cylinder block possessing piston cylinder. The piston cylinder has an intake valve and an exhaust valve. A piston moves in the piston cylinder. A crank chamber is provided in one side of the piston cylinder. Crank member located in the crank chamber and the piston are pivotally connected together by a connecting rod. When the crank member is rotated, the piston in the piston cylinder moves up and down. A spindle structure having a right spindle and a left spindle is provided. The left spindle located in crank chamber is pivotally connected to crank members and protrudes from one side of crank chamber. The right spindle located in the crank chamber is pivotally connected to the crank member and protrudes from the other side of crank chamber. The left and right spindles rotate synchronously. An intake cam is fixed on the left spindle and an exhaust cam is fixed on the right spindle. An intake switch in the intake valve opens or closes the intake valve by means of the intake cam. An exhaust switch in the exhaust valve opens or closes the exhaust valve by means of the exhaust cam. A motor drives the spindle to rotate and makes the intake valve and the exhaust valve open or close. The spindle also drives the piston to move up and down. Gas enters into the transit gas storage tank from the intake valve and discharges from the exhaust valve through piston compression.

Gas discharged from the pneumatic engine, the first booster pump, the second booster pump, and the third booster pump has residual pressure. This discharged gas will be recycled to the transit gas storage tank. The suction device is used to withdraw the gas to the second and third gas tanks. The recycled residual pressure can reduce gas consumption. In addition to energy saving and environmental protection, the present application also allows the pneumatic engine to maintain a longer running time and reduce attenuation speed of power output.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
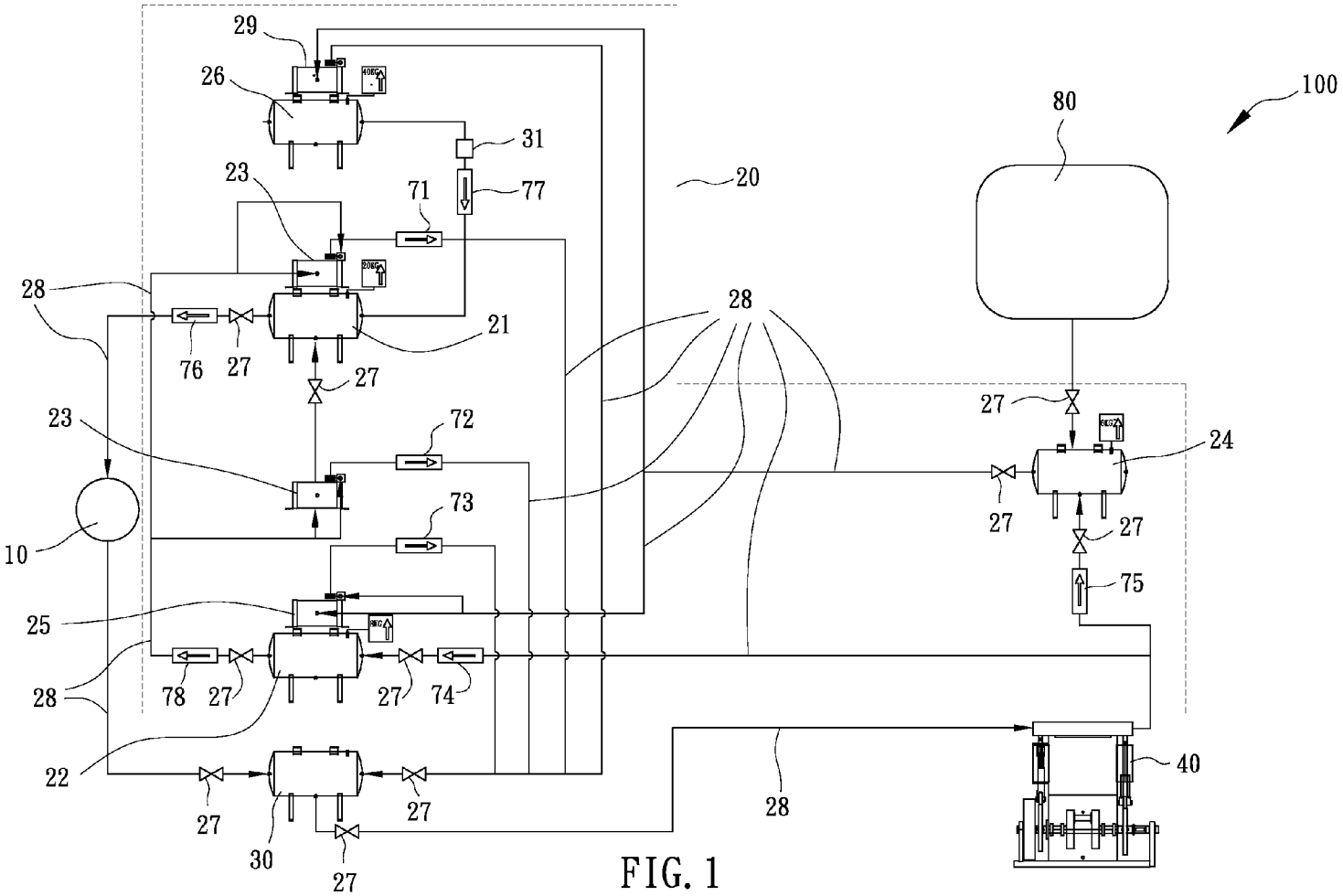
FIG. 1 is a system configuration diagram for the pneumatic engine system using gas circulation.

Referring to FIG. 1, a pneumatic engine system with gas circulation 100 including the pneumatic engine 10, the gas storage device 20, the transit gas storage tank 30 and the suction device 40 is provided.

The pneumatic engine 10 accepts compressed gas to produce power output. This is a way to convert compression energy of gas into kinetic energy. The pneumatic engine used in this embodiment is a power apparatus such as U.S. Pat. No. 7,866,251 B2 (corresponding cases include PCT/CN2007/001994, CN665571, and TWI327621, which are incorporated by reference by its entirety). The gas storage device 20 can store the compressed gas and provide it to the pneumatic engine 10. The gas storage device 20 in this embodiment includes the first gas tank 21, the second gas tank 22, the first booster pump 23, the third gas tank 24 and the second booster pump 25. The first gas tank 21 stores the compressed gas and supplies it to the pneumatic engine 10. The second gas tank 22 also stores the compressed gas. The pressure in the second tank 22 is less than the pressure in the first gas tank 21. Therefore, the first booster pump 23 located between the first gas tank 21 and the second gas tank 22 is used to pressurize output gas from the second gas tank 22. The pressurized compressed gas is then delivered to the first gas tank 21. There are two first booster pumps 23 used in this embodiment. The third gas tank 24 stores compressed gas and the pressure in this tank is less than the pressure in the second gas tank 22. The second booster pump 25 located between the second gas tank 22 and the third gas tank 24 is used to pressurize gas output from the third gas tank 24. The pressurized gas is stored in the second gas tank 22.

In FIG. 1, the gas storage device 20 includes a high pressure gas supplement tank 26, the third booster pump 29 and a regulator valve 31. The high pressure gas supplement tank 26 is for the storage of compressed gas and the pressure is greater than the pressure in the first gas tank 21. When pressure in the first gas tank is below the set value, the regulator valve 31 is opened. The high pressure gas supplement tank 26 replenishes pressurized gas to the first gas tank 21. The regulator valve 31 is closed to stop supplying gas until the pressure in the first gas tank 21 is higher than the set value. The third booster pump 29 located between high pressure supplement tank 26 and the third gas tank 24 is used to pressurize output gas from the third gas tank 24. The pressurized compressed gas is then delivered to the high pressure supplement tank 26.

As described above, gas discharged from the pneumatic engine 10, the first booster pump 23, the second booster pump 25 and the third booster pump 29 still has residual pressure. The transit gas storage tank 30 is used to retrieve gas discharged. The suction device 40 is used to withdraw gas discharged to the second gas tank 22 and/or the third gas tank 24 in the gas storage device 20. The recycled residual pressure can reduce gas consumption. In addition to energy saving and environmental protection, the present application also allow the pneumatic engine to maintain a longer running time and reduce attenuation speed of power output.

The check valves 71, 72, 73 are installed in the first booster pump 23, the second booster pump 25 and the transit gas storage tank 30, respectively. The check valve 74 and 75 are installed between the suction device 40, the second gas tank 22, and the third gas tank 24. The check valve 76 is installed between the first gas tank 21 and the pneumatic engine. The check valve 78 is installed between the second gas tank 22 and the first booster pump 23 and the check valve 77 is located between the high pressure gas supplement tank 26 and the first gas tank 21. The check valves are operable to avoid gas reversing.

Referring to FIGS. 2 to 12, the suction device 40 in this embodiment includes a cylinder block 41, a piston 42, a crank chamber 43, a crank member 44, a spindle 45, an intake cam 46, an exhaust cam 47, an intake switch 48, an exhaust switch 49 and a motor 50.

The cylinder block 41 includes the piston cylinder 411, which has the intake valve 412 and the exhaust valve 413. The piston 42 is located and operable to move in the piston cylinder 411. The crank chamber 43 is provided at one side of the piston cylinder 411. In this embodiment, the crank chamber is located on the bottom side. The crank member 44 is disposed in crank chamber 43. The crank member 44 has a connecting rod 441. The crank member 44 and the piston 42 are pivotally connected together by the connecting rod 441. When the crank member 44 is rotated, the piston 42 in the piston cylinder 411 moves up and down. In this embodiment, the spindle 45 having a left spindle 451 and a right spindle 452 is provided. The left spindle 451 located in the crank chamber 43 is pivotally connected to the crank member 44 and protrudes from one side of crank chamber 43. The right spindle 452 located in the crank chamber 43 is pivotally connected to the crank member 44 and protrudes from the other side of crank chamber 43. The left spindle and right spindle rotates synchronously. The intake cam 46 is fixed on the left spindle 451 and the exhaust cam 47 is fixed on the right spindle 452. In addition, the intake switch 48 located in the intake valve 412 opens or closes the intake valve 412 by means of the intake cam 46. The exhaust switch 49 located in the exhaust valve 413 opens or closes the exhaust valve 413 by means of the exhaust cam 47.

Figure 11:
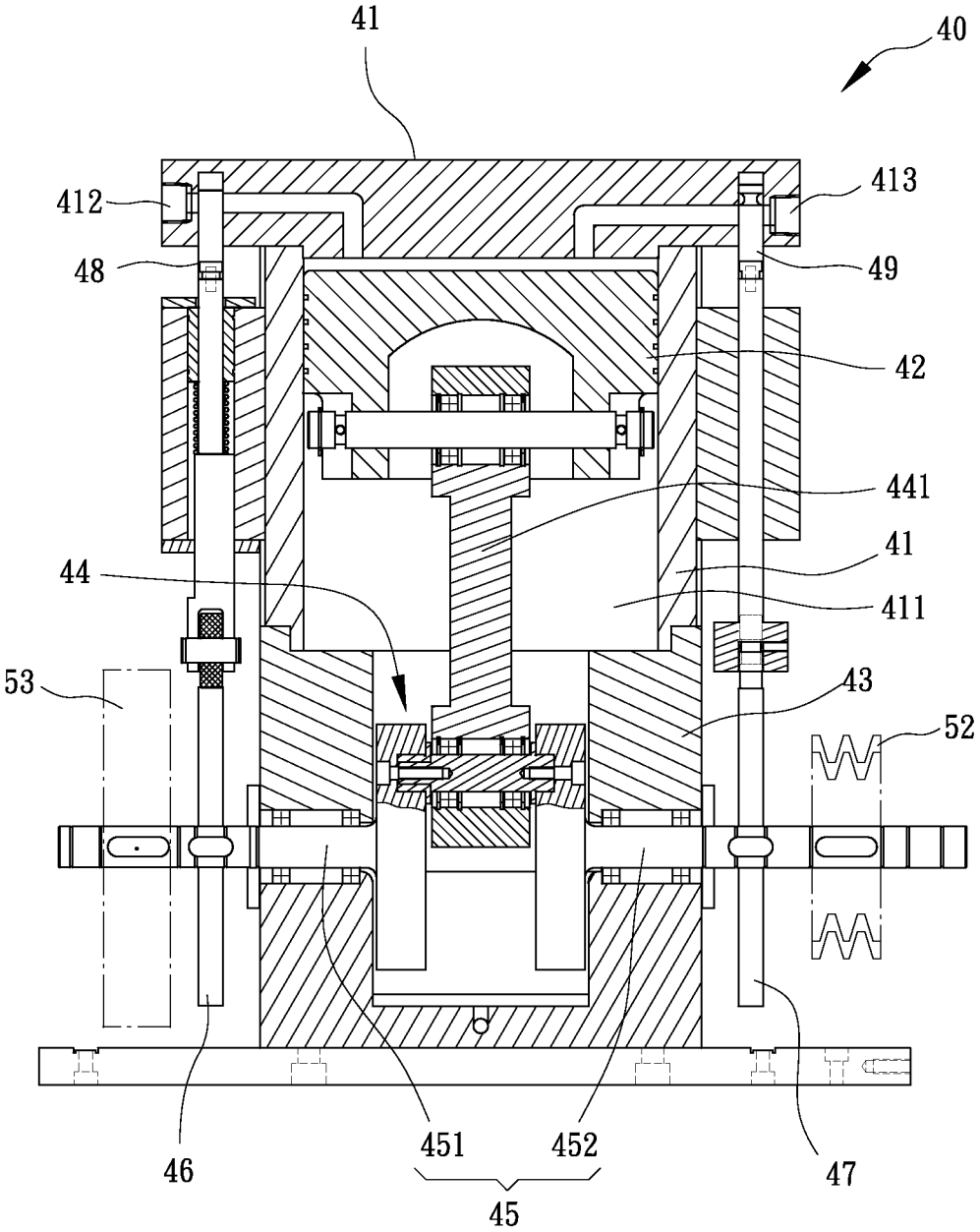
FIG. 11 is a cross-sectional view of the suction device in the pneumatic engine and also shows the idler and pulley.
Figure 12:
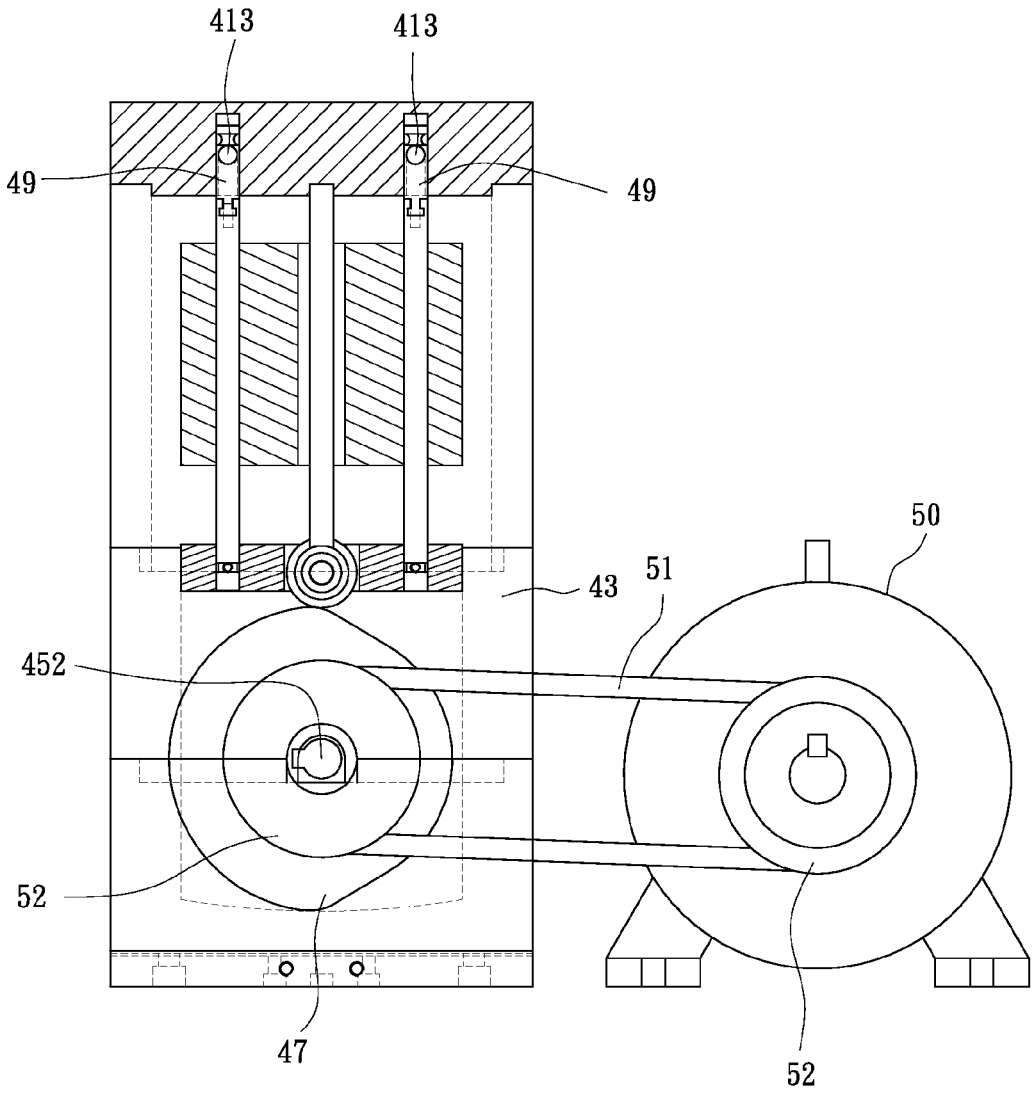
FIG. 12 is a cross-sectional view displaying the pneumatic engine and motor.

The motor 50 drives the spindle 45 to rotate and makes the intake valve 412 and the exhaust valve 413 open or close. The spindle 45 also drives the piston 42 to move up and down. Gas enters into the transit gas storage tank 30 from the intake valve 412 and discharges from the exhaust valve 413 through the piston 42 compression. In the embodiment as shown in FIGS. 11 and 12, rotation of the right spindle 452 in the spindle 45 is driven by the motor 50 through the belt 51 and the pulley 52. In addition, the left spindle 451 has an idler 53. The moment of inertia from the idler 53 assists the operation of the suction device 40.

Figure 4:
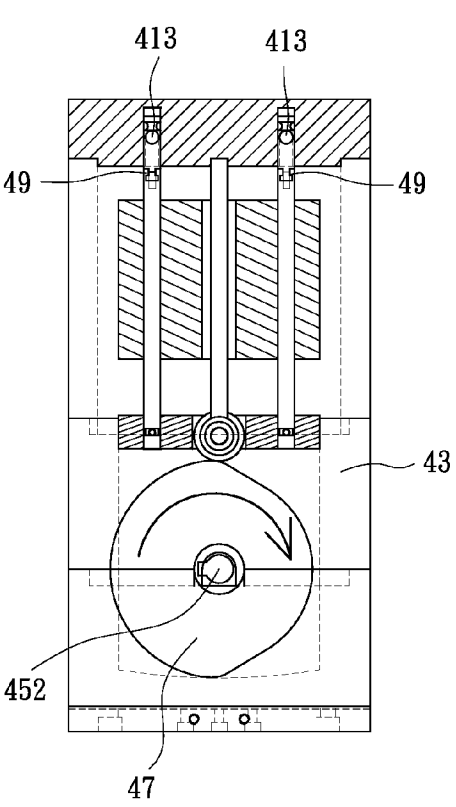
FIG. 4 is another side view of FIG. 2.
Figure 2:
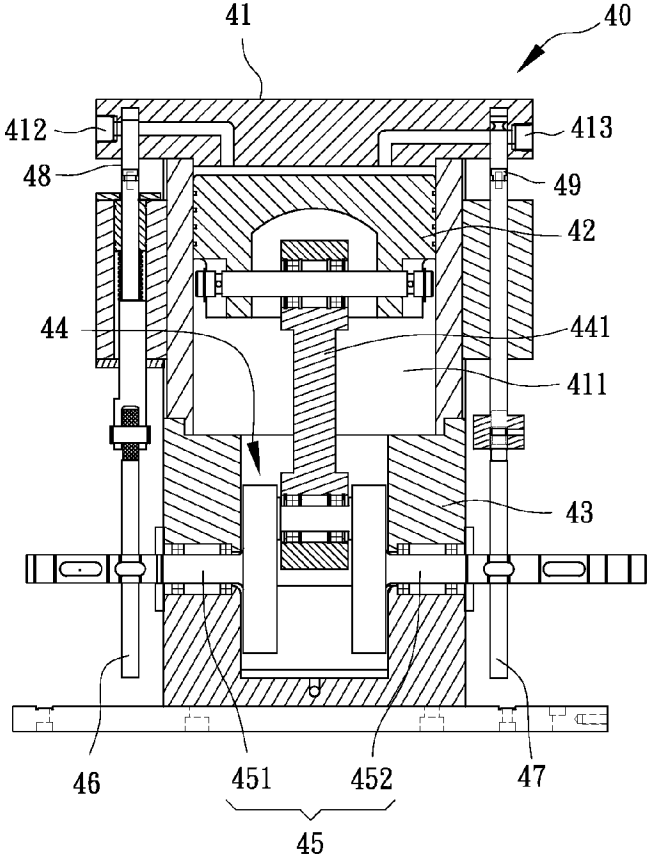
FIG. 2 is a cross-sectional view of the suction device in the pneumatic engine and displays the spindle in the initial state.
Figure 3:
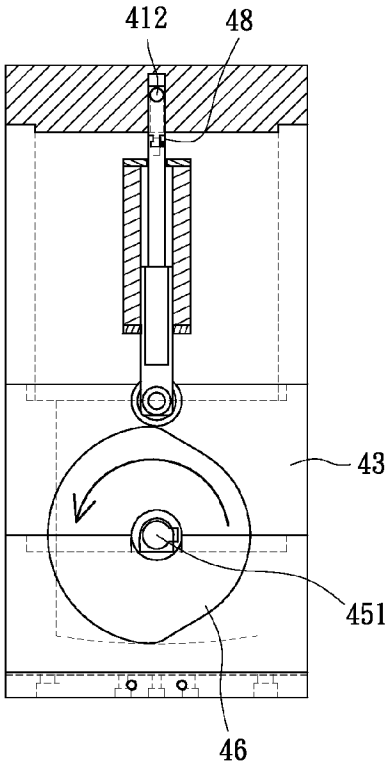
FIG. 3 is a side view of FIG. 2.
Figure 7:
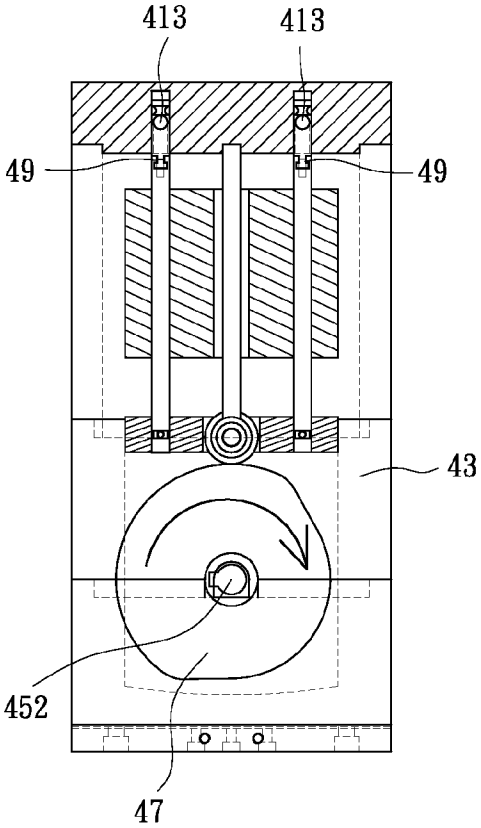
FIG. 7 is another side view of FIG. 5.
Figure 5:
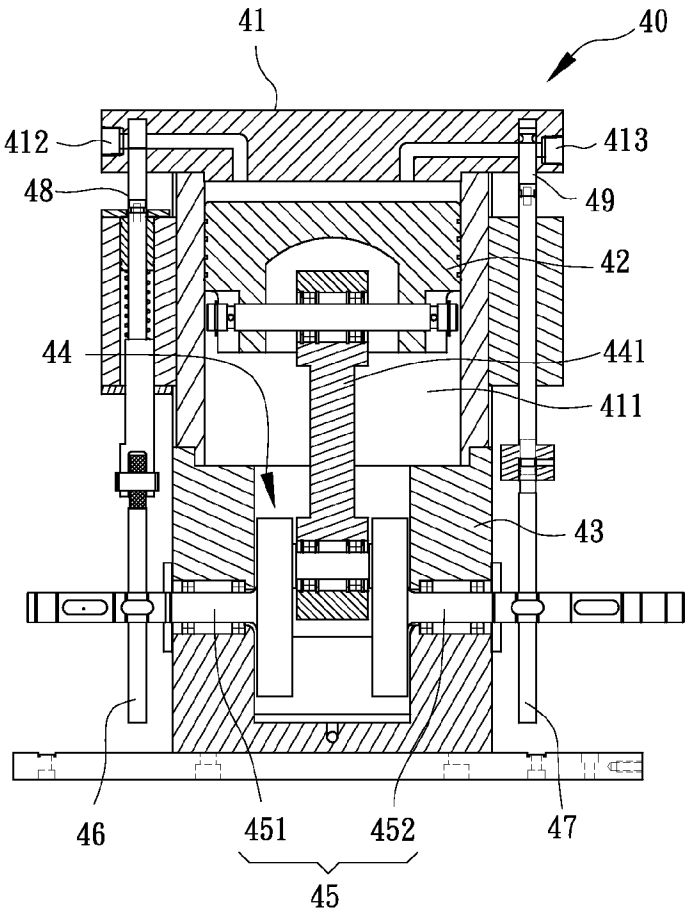
FIG. 5 is a cross-sectional view of the suction device in the pneumatic engine and displays the spindle rotating 30 degree.
Figure 6:
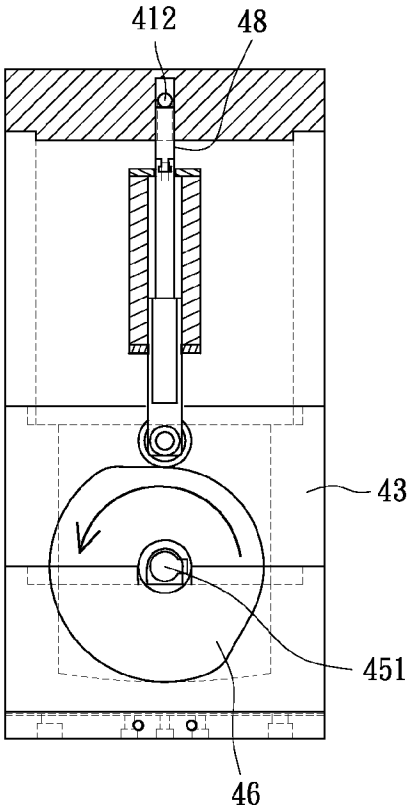
FIG. 6 is a side view of FIG. 5.
Figure 10:
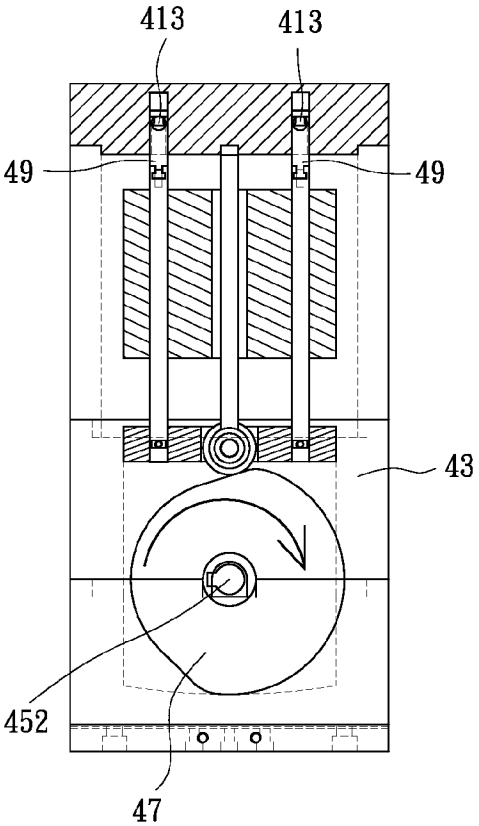
FIG. 10 is another side view of FIG. 8.
Figure 8:
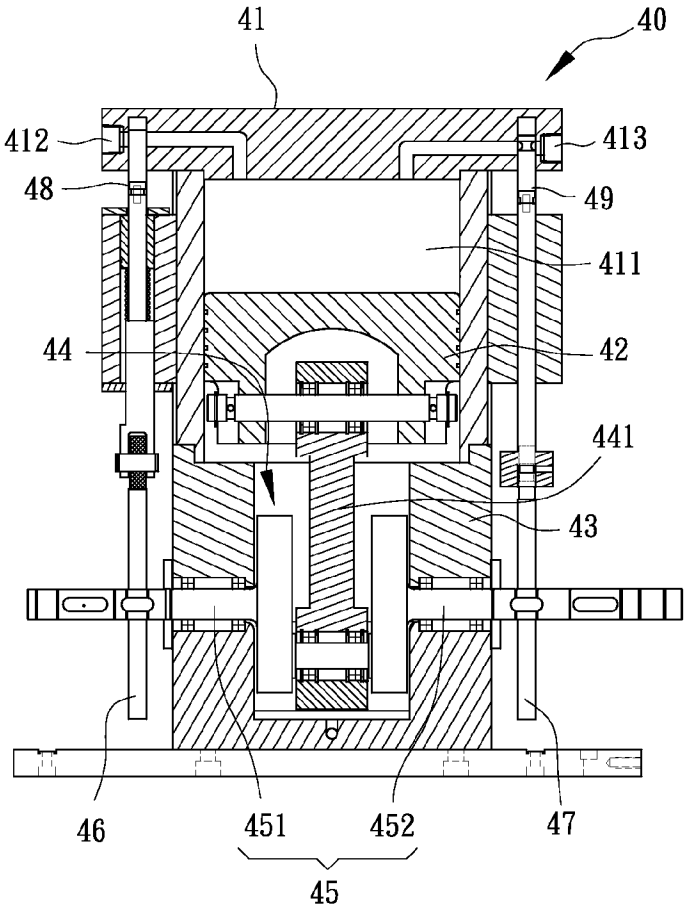
FIG. 8 is a cross-sectional view of the suction device in the pneumatic engine and displays the spindle rotating 193.5 degree.
Figure 9:
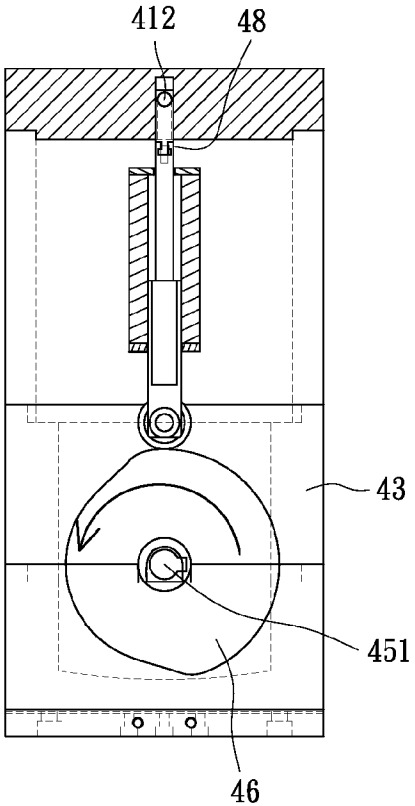
FIG. 9 is a side view of FIG. 8.
Figure 13:
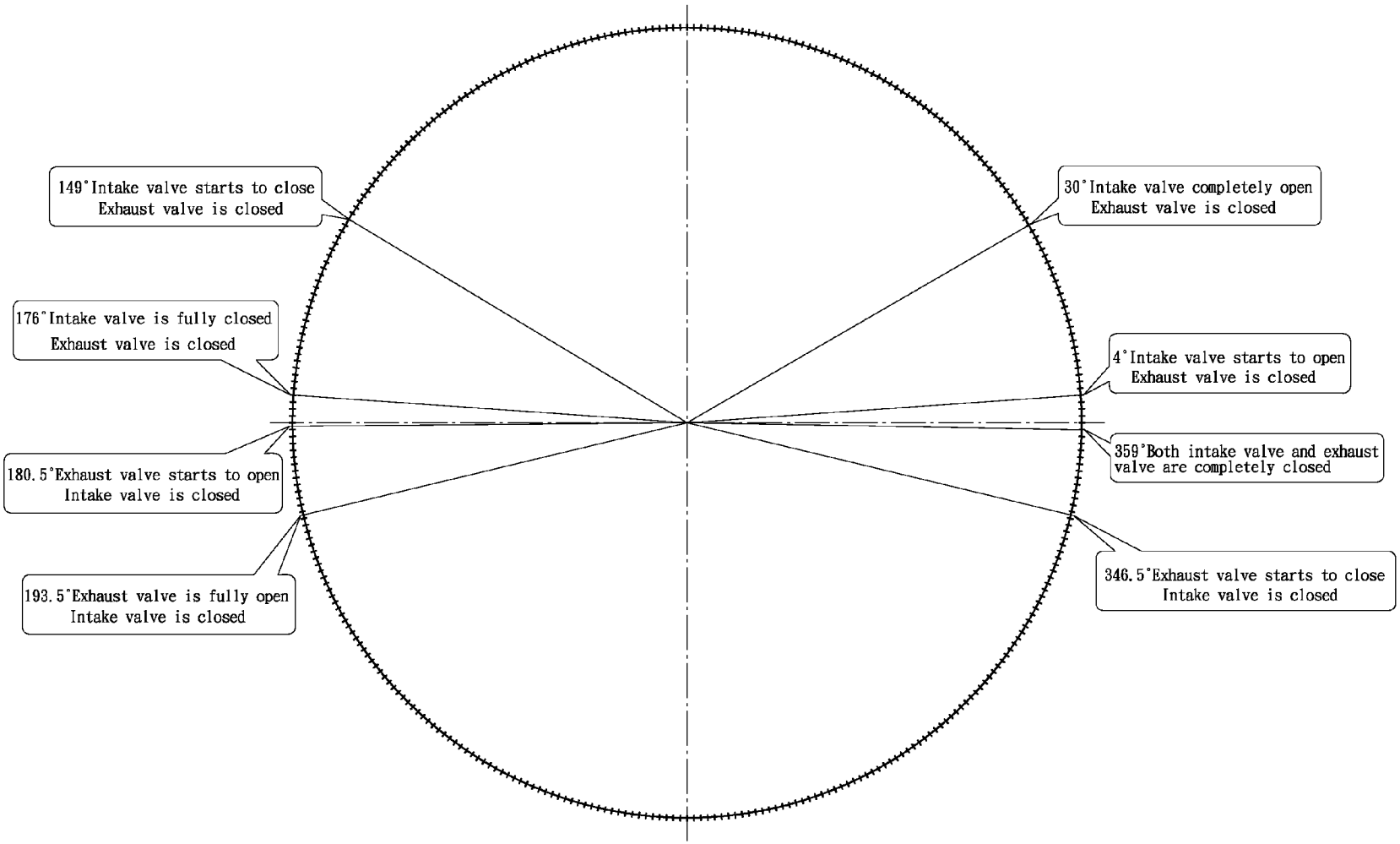
FIG. 13 is a relational diagram showing rotation angles of the spindle, intake valve and exhaust valve in the pneumatic engine.

Referring to FIG. 13, the piston 42 as shown in FIGS. 2-4 is at the highest point for the beginning of a cycle. The intake valve 412 and the exhaust valve 413 are in the close state. When the spindle 45 rotates to about 4°, the intake valve 412 starts to open and the exhaust valve 413 is still in the closed state. Referring to FIGS. 5 to 7, when the spindle 45 rotates to about 30°, the intake valve 412 is fully open and the exhaust valve is still in the closed state. While the piston 42 goes down, gas enters into the piston cylinder 411. When the spindle 45 rotates to about 149°, the intake valve 412 starts to close and the exhaust valve still remains in the closed state. When the spindle 45 rotates to about 176°, the intake valve 412 is fully closed and the exhaust valve 413 is still in the closed state. When the spindle 45 rotates to about 180.5°, the exhaust valve 413 starts to open and the intake valve 412 is closed. The piston 42 starts to rise and gas is then pushed out. Referring to FIGS. 8 to 10, when the spindle 45 rotates to about 193.5°, the exhaust valve 413 is fully open and the intake valve 412 is closed. When the spindle 45 rotates to about 346.5°, the exhaust valve 413 starts to close and the intake valve 412 is still in the closed state. When the spindle 45 rotates to about 359°, both the intake valve 412 and the exhaust valve 413 are closed. When the piston 42 reaches the highest point, gas in the piston cylinder 42 is pushed out completely. When the spindle 45 rotates to about 360°, both the intake valve 412 and the exhaust valve 413 are closed. A full cycle of piston 42 has been completed. Gas in the transit gas storage tank 30 can be effectively pumped into the second gas storage tank 22 and the third gas storage tank 24 by the suction device 40.

This embodiment further comprises an air compressor/gas storage cylinder set 80. When the third gas tank 24 is insufficient pressure, the air compressor/gas storage cylinder set 80 supplements the pressure in the third gas tank 24.

In FIG. 1, a switch valve 27 is provided to a pipeline 28 which is used to connect the first gas tank 21, the second gas tank 22 and the third gas tank 24. The switch valve 27 can open and close the external path and can also be conveniently inflated in advance for the first gas tank 21, the second gas tank 22 and the third gas tank 24.

Operation instructions for this embodiment are as follows. Firstly, the high pressure gas supplementary tank 26, the first gas tank 21, the second gas tank 22 and the third gas tank 24 are filled with sufficient gas. In this embodiment, the pressure in the high pressure gas supplementary tank 26 should be maintained between about 25 kg/cm$^2$ and about 40 kg/cm$^2$. The pressure in the first gas tank 21 is at about 16 kg/cm$^2$. The pressure of the second gas tank 22 is at about 8 kg/cm$^2$. The pressure of the third gas tank 24 is at about 6 kg/cm$^2$. When the pneumatic engine 10 opens, the first gas tank 21 starts to supply gas. Gas discharged from the pneumatic engine 10 is recycled by he the transit gas storage tank 30 and the suction device 40 withdraws gas discharged to the second gas tank 22 or/and the gas tank 24 for recycling. After the second booster pump 25 pressurizes the gas from the third gas tank 24, the pressurized gas is then sent to the second gas tank 22. After the first booster pump 23 pressurizes gas discharged from the second gas tank 22, the pressurized gas discharged is sent to the first gas tank for recycling. When the pressure of the first gas tank 21 is insufficient, the high pressure gas supplementary tank 26 is responsible for replenishing. Gas discharged in the first booster pump 23, the second booster pump 25 and the third booster pump is all sent to the transit gas storage tank 30 to complete a recycling loop. Of course, the air compressor/gas storage cylinder set 80 should replenish gas if any gas consumption occurs during this time period. Therefore, this embodiment attenuates gas consumption to a minimum level by using recycling gas.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A pneumatic engine system with gas circulation, comprising:

a pneumatic engine receiving a compressed gas to produce power output;

a gas storage device storing the compressed gas and supplying the compressed gas to the pneumatic engine;

a transit gas storage tank recycling a gas discharged from the pneumatic engine; and a suction device transporting the gas recycled by transit gas storage tank to the gas storage device, wherein the gas storage device comprises:

a first gas tank storing the compressed gas and providing the compressed gas to the pneumatic engine;

a second gas tank storing the compressed gas, wherein a pressure in the second gas tank is less than a pressure in the first gas tank;

a third gas tank storing the compressed gas, wherein a pressure in the third gas tank is less than the pressure in the second gas tank;

a first booster pump located between the first gas tank and the second gas tank for pressurizing the compressed gas output from the second gas tank and supplying the pressurized compressed gas to the first gas tank;

a second booster pump located between the second gas tank and the third gas tank for pressurizing the compressed gas output from the third gas tank and supplying the pressurized compressed gas to the second gas tank;

wherein gases discharged from the first booster pump and the second booster pump are transported to the transit gas storage tank for recycling; and the suction device is configured to withdraw gas from the transit gas tank and transport the withdrawn gas to the second gas storage tank and/or the third gas storage tank.

2. The system of claim 1, further comprising an air compressor and gas cylinder set for supplementing pressure to the third gas tank when a pressure in the third gas tank is insufficient.

3. The system of claim 1, wherein the suction device comprises:

a cylinder block possessing a piston cylinder and the piston cylinder having an intake valve and an exhaust valve;

a piston located in the piston cylinder and moved in the piston cylinder;

a crank chamber provided in one side of the piston cylinder;

a crank member, having a connecting rod to pivotally connect the piston together, located in the crank chamber to make the piston in the piston cylinder move up and down by means of its rotation;

a spindle having a left spindle located in the crank chamber pivotally connected to the crank member and protruded from one side of the crank chamber and a right spindle located in the crank chamber pivotally connected to the crank member and protruded from the other side of crank chamber, wherein the left and right spindle rotates synchronously;

an intake cam fixed on the left spindle;

an exhaust cam fixed on the right spindle;

an intake valve, having an intake switch, opened or closed by an intake cam;

an exhaust valve, having an exhaust switch, opened or closed by an exhaust cam;

a motor driving the spindle to rotate the piston to move up and down and also making the intake valve and exhaust valve open or close, wherein gas enters into the transit gas storage tank from the intake valve and discharges from the exhaust valve by the piston compression.

4. The system of claim 1, further comprising two first booster pumps to pressurize gas discharged from the second gas tank and then supply the pressurized gas to the first gas tank.

5. The system of claim 1, further comprising:

a high pressure gas supplement tank storing the compressed gas in order to replenish the compressed gas to the first gas tank, wherein the pressure in the high pressure gas supplement tank is greater than the pressure in the first gas tank; and a regulator valve opened or closed according to the pressure in the first gas tank below or above the set value.

6. The system of claim 5, further comprising a third booster pump located between a high pressure supplement tank and the third gas tank to pressurize the gas from the third gas tank and then deliver the pressurized gas to the high pressure supplement tank.

* * * * *